US005701852A

United States Patent [19]

Suzuki et al.

[11] Patent Number: 5,701,852

[45] Date of Patent: Dec. 30, 1997

[54] COOLANT TEMPERATURE CONTROL SYSTEM FOR VEHICLES

[75] Inventors: Kazutaka Suzuki; Yasutoshi Yamanaka, both of Kariya; Tatsuo Sugimoto, Obu, all of Japan

[73] Assignee: Nippondenso Co., Ltd., Kariya, Japan

[21] Appl. No.: 696,512

[22] Filed: Aug. 14, 1996

[30] Foreign Application Priority Data

Aug. 31, 1995 [JP] Japan ..... 7-222821

[51] Int. Cl.[6] ..... F01P 11/02

[52] U.S. Cl. ..... 123/41.14; 123/142.5 R

[58] Field of Search ..... 123/41.14, 142.5 R

[56] References Cited

FOREIGN PATENT DOCUMENTS 2913650 10/1980 Germany ..... 123/41.14

58-133415 8/1983 Japan .

*Primary Examiner*—Noah P. Kamen

*Attorney, Agent, or Firm*—Harness, Dickey & Pierce

[57] ABSTRACT

According to the present invention, coolant temperature Tw after an engine has stopped is detected by a coolant-temperature sensor. An amount of temperature rise ΔTw is calculated from a temperature difference between the present coolant temperature (Tw) and the previous coolant temperature (Tw−1). It is determined on the basis of the amount of temperature rise ΔTw whether coolant temperature after the engine has stopped has reached a substantially maximum temperature. Specifically, the amount of temperature rise ΔTw and a set amount of temperature rise ΔT which has been set in advance are compared, and in a case where ΔTw>ΔT, temperature rise is large and coolant temperature is still rising. Therefore, recovery of coolant is not performed. When ΔTw≦ΔT, the amount of temperature rise is small and the present temperature is substantially the maximum temperature, and an electrical pump is operated to recover coolant. In this way, it is possible to recover a higher-temperature coolant into insulated container after the engine has stopped.

17 Claims, 9 Drawing Sheets

COOLANT TEMPERATURE CONTROL SYSTEM FOR VEHICLES

CROSS REFERENCE TO RELATED APPLICATION

This application is based on and claims priority of Japanese Patent Application No. Hei. 7-222821 filed on Aug. 31, 1995, the content of which is incorporated herein by reference.

BACKGROUND OF THE INVENTION

1. Field of the Invention

The present invention relates to a coolant temperature control system for vehicles, which is provided with a heat insulating container for thermally keeping coolant after an engine has stopped.

2. Description of Related Art

The present applicant discloses a system for warming an engine by returning warm water from an insulated container during engine starting.(Japanese Patent Application No. Hei. 7-8611). A passage is provided in the system for allowing air in the insulated container to enter the engine when coolant is recovered from the engine into the insulated container. The passage also allows air in the engine to enter the insulated container when coolant is returned from the insulated container into the engine. In this way, it is possible to perform the exchange of coolant and air between the engine and the insulated container and to warm the engine immediately and efficiently.

In the present system, and in the prior art systems where warm coolant is accumulated in an insulated container, a temperature drop of the coolant is unavoidable. To improve the warming of the engine, it is preferred that the highest temperature coolant possible should be accumulated within the insulated container. However, in the prior art systems, when an OFF signal of an ignition switch has been detected, coolant is immediately recovered, and therefore, the temperature of the coolant at that time may not always be the highest. When an engine is stopped after the vehicle has traveled, there occurs a phenomenon (so-called "dead soak") where coolant temperature rises. Therefore, the coolant temperature is not always the highest immediately after the engine is stopped (when the ignition switch is turned off). In the prior art system, there has been a problem in that the highest temperature coolant is not always being kept in the insulated container.

SUMMARY OF THE INVENTION

In light of the above problems, an object of the present invention is to provide a coolant temperature control system for vehicles capable of recovering the highest temperature coolant from the engine and keeping the higher temperature coolant in the heat insulated container.

According to the present invention, means for detecting coolant temperature after an engine has stopped is utilized. Once it is determined that coolant temperature, after the engine has stopped, has reached a substantially maximum temperature, a pump is operated to recover coolant from the engine into the insulated container. In this way, coolant having a higher temperature as compared with prior art systems can be accumulated in the insulated container.

The maximum temperature may be determined on the basis of a difference between the present coolant temperature and a previous coolant temperature.

Further, the maximum temperature may be determined by calculating an amount of temperature rise per set time from the detected value of coolant and judging that the calculated amount of temperature rise is equal to a set amount of temperature rise or less.

The determination whether coolant temperature after the engine has stopped has reached a substantially maximum temperature can be easily performed according to a rise ratio of coolant temperature (i.e., rate of change in temperature rise amount per set time) after the engine has stopped. Specifically, when the rise ratio of coolant temperature after the engine has stopped is large (i.e., when the amount of temperature rise per set time is larger than a set amount of temperature rise), coolant temperature can be assumed to be still rising. Accordingly, when the rise ratio of coolant temperature after the engine has stopped has become small and the amount of temperature rise per set time becomes the set amount of temperature rise or less, it can be determined that coolant temperature has reached a substantially maximum temperature.

Coolant accumulated in the insulated container is supplied to the engine during starting of the engine.

In this way, it is possible to warm the engine immediately by supplying coolant of a higher temperature as compared with the conventional starting of the engine, and engine startability is thereby improved.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF THE PREFERRED EMBODIMENTS

An embodiment of a coolant temperature control system for vehicles according to the present invention will be described.

Figure 1:
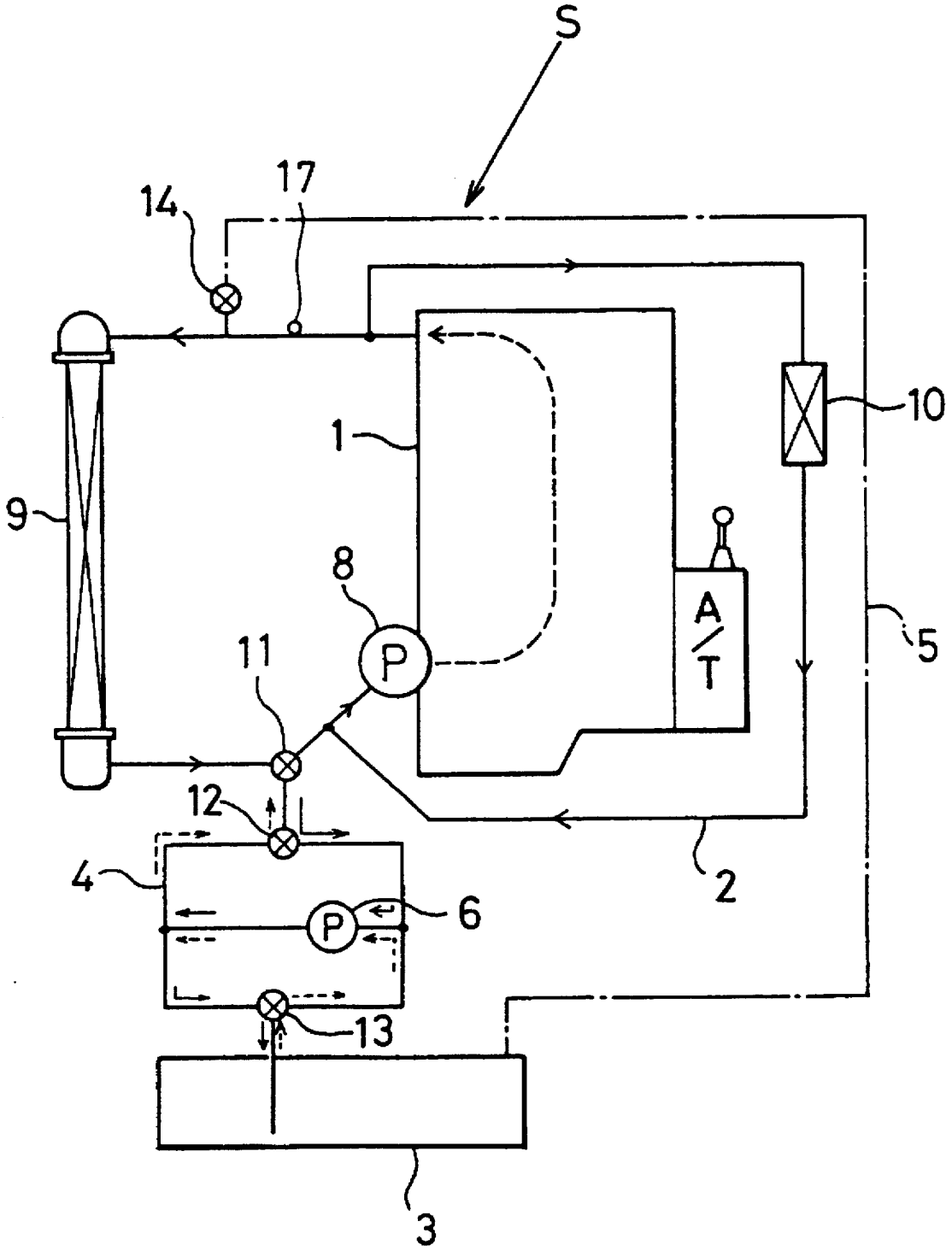
FIG. 1 is an overall schematic view of a coolant temperature control system for vehicles according to a first embodiment.

FIG. 1 is an overall schematic view of a coolant temperature control system S for vehicles.

Coolant temperature control system S includes a water-cooled engine 1, a coolant circuit 2 through which coolant (cooling water) circulates into the engine 1, an insulated container 3 for coolant, a coolant passage 4 and a degassing passage 5 for communicating engine 1 with insulated container 3 through coolant circuit 2, an electrical pump 6

BEST AVAILABLE COPY disposed in coolant passage 4, and a control unit 7 (see FIG. 2) for controlling system S.

Engine 1 is provided with a water jacket (not illustrated) in a cylinder block and a cylinder head for communicating with coolant circuit 2, and is cooled by coolant flowing through the water jacket.

Coolant circuit 2 is provided with a mechanical type main pump 8 driven by engine 1, a radiator 9 for radiating heat of coolant heated by cooling engine 1 to the atmosphere with air blown by a cooling fan (not illustrated), and a heater core 10 for heating air passing therethrough (i.e., air blown into the passenger compartment) with high-temperature coolant as a heat source.

Insulated container 3 can accumulate a predetermined amount (for example approximately 3 liters) of coolant therein for an extended period while maintaining the temperature of the coolant. Specifically, coolant of approximately 85° C. can be kept warm to approximately 78° C. after 12 hours has passed in an ambient temperature of 0° C.

One end of coolant passage 4 is connected through a solenoid valve 11 to coolant circuit 2 on a downstream side of radiator 9, and the other end is opened to the interior of insulated container 3. However, coolant passage 4 forms a coolant recovering passage (the passage indicated by solid-line arrows in the drawing) for recovering coolant in insulated container 3 from engine 1 or a coolant return passage (the passage indicated by broken-line arrows in the drawing) for returning coolant from insulated container 3 to engine 1. The coolant recovering passage and coolant return passage are switched by solenoid valve 11 and two solenoid valves 12 and 13 disposed in coolant passage 4.

One end of degassing passage 5 is opened to the interior of insulated container 3, and the other end is connected to coolant circuit 2 on the upstream side of radiator 9. Air flows in a direction oppositely to the direction of coolant flow when coolant passes through coolant passage 4 and is recovered into insulated container 3 from engine 1 and when coolant is returned from insulated container 3 to engine 1. That is, when coolant passes through coolant passage 4 (i.e., the coolant recovering passage) and is recovered into insulated container 3 from engine 1, air in insulated container 3 passes through degassing passage 5 and is sent into engine 1, and when coolant passes through coolant passage 4 (i.e., the coolant return passage) and is returned from insulated container 3 into engine 1, air in engine 1 passes through air degassing passage 5 and is sent into insulated container 3. Additionally, a solenoid valve 14 for opening and closing degassing passage 5 is provided in degassing passage 5.

Electrical pump 6 is preferably a centrifugal type pump driven so as to rotate by a motor (not illustrated), and generate coolant flow (indicated by arrows in FIG. 1) in coolant passage 4.

Control unit 7 controls electrical pump 6 and solenoid valves 11 through 14 in each operating mode, which will be described below (see FIG. 2).

Operating modes include a low-load mode when engine 1 is in a low load operating condition where the vehicle travel is low, a middle-high load mode when engine 1 is in a middle or high load operating condition, a coolant recovery mode when coolant is recovered into insulated container 3 from engine 1 after engine 1 has stopped, and a coolant return mode when coolant is returned from insulated container 3 into engine 1 during engine starting.

The load condition of engine 1 can be determined on the basis of a detected signal of a pressure sensor 15 (see FIG. 2) for detecting pressure change of, for example, an intake manifold (not illustrated) and converting the pressure change to a voltage change.

Additionally, the coolant recovery mode is ended when a water level of coolant collected within insulated container 3 has reached an upper-limit water level which was set in advance. Meanwhile, the coolant return mode is ended when the water level of coolant collected within insulated container 3 has reached a lower-l

* * * * *

UNITED STATES PATENT AND TRADEMARK OFFICE

CERTIFICATE OF CORRECTION

PATENT : 5,701,852

DATED : December 30, 1999

INVENTOR(S) : Kazutaka Suzuki, et al.

It is certified that error appears in the above-identified patent and that said Letters Patent is hereby corrected as shown below:

The columns 1-4, should be deleted and substitute therefor the attached columns 1-16.

Signed and Sealed this

First Day of May, 2001

*Attest:*

Nicholas P. Godici

NICHOLAS P. GODICI

*Attesting Officer*

*Acting Director of the United States Patent and Trademark Office*

COOLANT TEMPERATURE CONTROL SYSTEM FOR VEHICLES

CROSS REFERENCE TO RELATED APPLICATION

This application is based on and claims priority of Japanese Patent Application No. Hei. 7-222821 filed on Aug. 31, 1995, the content of which is incorporated herein by reference.

BACKGROUND OF THE INVENTION

1. Field of the Invention

The present invention relates to a coolant temperature control system for vehicles, which is provided with a heat insulating container for thermally keeping coolant after an engine has stopped.

2. Description of Related Art

The present applicant discloses a system for warming an engine by returning warm water from an insulated container during engine starting. (Japanese Patent Application No. Hei. 7-8611). A passage is provided in the system for allowing air in the insulated container to enter the engine when coolant is recovered from the engine into the insulated container. The passage also allows air in the engine to enter the insulated container when coolant is returned from the insulated container into the engine. In this way, it is possible to perform the exchange of coolant and air between the engine and the insulated container and to warm the engine immediately and efficiently.

In the present system, and in the prior art systems where warm coolant is accumulated in an insulated container, a temperature drop of the coolant is unavoidable. To improve the warming of the engine, it is preferred that the highest temperature coolant possible should be accumulated within the insulated container. However, in the prior art systems, when an OFF signal of an ignition switch has been detected, coolant is immediately recovered, and therefore, the temperature of the coolant at that time may not always be the highest. When an engine is stopped after the vehicle has traveled, there occurs a phenomenon (so-called "dead soak") where coolant temperature rises. Therefore, the coolant temperature is not always the highest immediately after the engine is stopped (when the ignition switch is turned off). In the prior art system, there has been a problem in that the highest temperature coolant is not always being kept in the insulated container.

SUMMARY OF THE INVENTION

In light of the above problems, an object of the present invention is to provide a coolant temperature control system for vehicles capable of recovering the highest temperature coolant from the engine and keeping the higher temperature coolant in the heat insulated container.

According to the present invention, means for detecting coolant temperature after an engine has stopped is utilized. Once it is determined that coolant temperature, after the engine has stopped, has reached a substantially maximum temperature, a pump is operated to recover coolant from the engine into the insulated container. In this way, coolant having a higher temperature as compared with prior art systems can be accumulated in the insulated container.

The maximum temperature may be determined on the basis of a difference between the present coolant temperature and a previous coolant temperature.

Further, the maximum temperature may be determined by calculating an amount of temperature rise per set time from the detected value of coolant and judging that the calculated amount of temperature rise is equal to a set amount of temperature rise or less.

The determination whether coolant temperature after the engine has stopped has reached a substantially maximum temperature can be easily performed according to a rise ratio of coolant temperature (i.e., rate of change in temperature rise amount per set time) after the engine has stopped. Specifically, when the rise ratio of coolant temperature after the engine has stopped is large (i.e., when the amount of temperature rise per set time is larger than a set amount of temperature rise), coolant temperature can be assumed to be still rising. Accordingly, when the rise ratio of coolant temperature after the engine has stopped has become small and the amount of temperature rise per set time becomes the set amount of temperature rise or less, it can be determined that coolant temperature has reached a substantially maximum temperature.

Coolant accumulated in the insulated container is supplied to the engine during starting of the engine.

In this way, it is possible to warm the engine immediately by supplying coolant of a higher temperature as compared with the conventional starting of the engine, and engine startability is thereby improved.

BRIEF DESCRIPTION OF THE DRAWINGS

Figure 2:
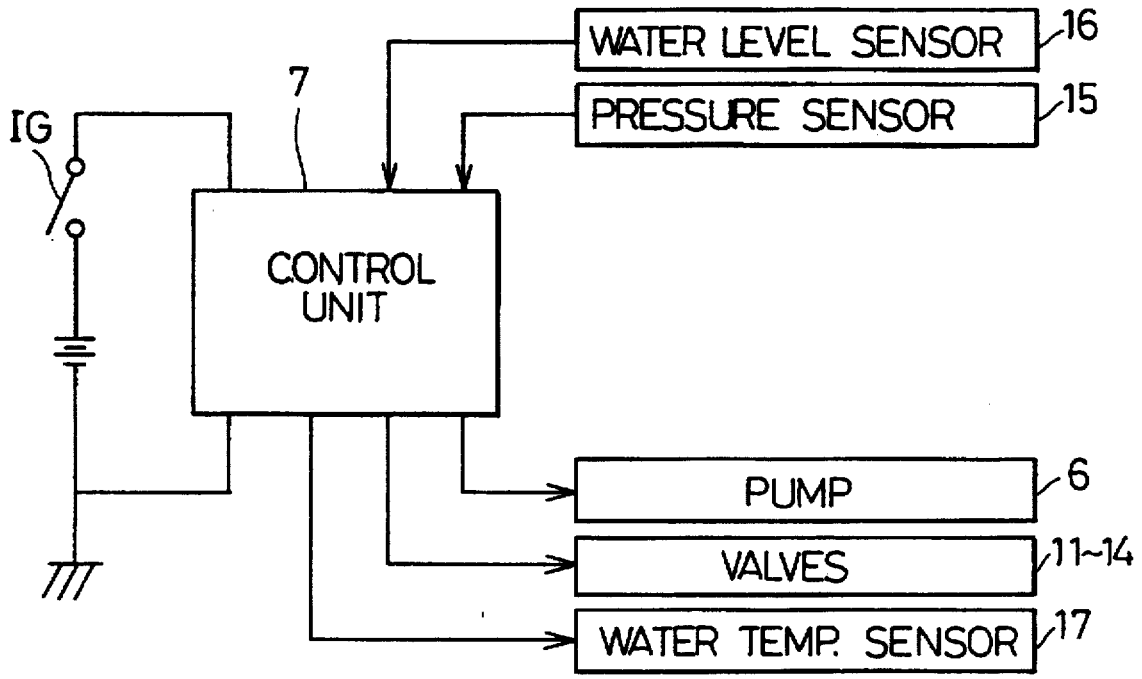
FIG. 2 shows a control unit of the control system according to the first embodiment.
Figure 3:
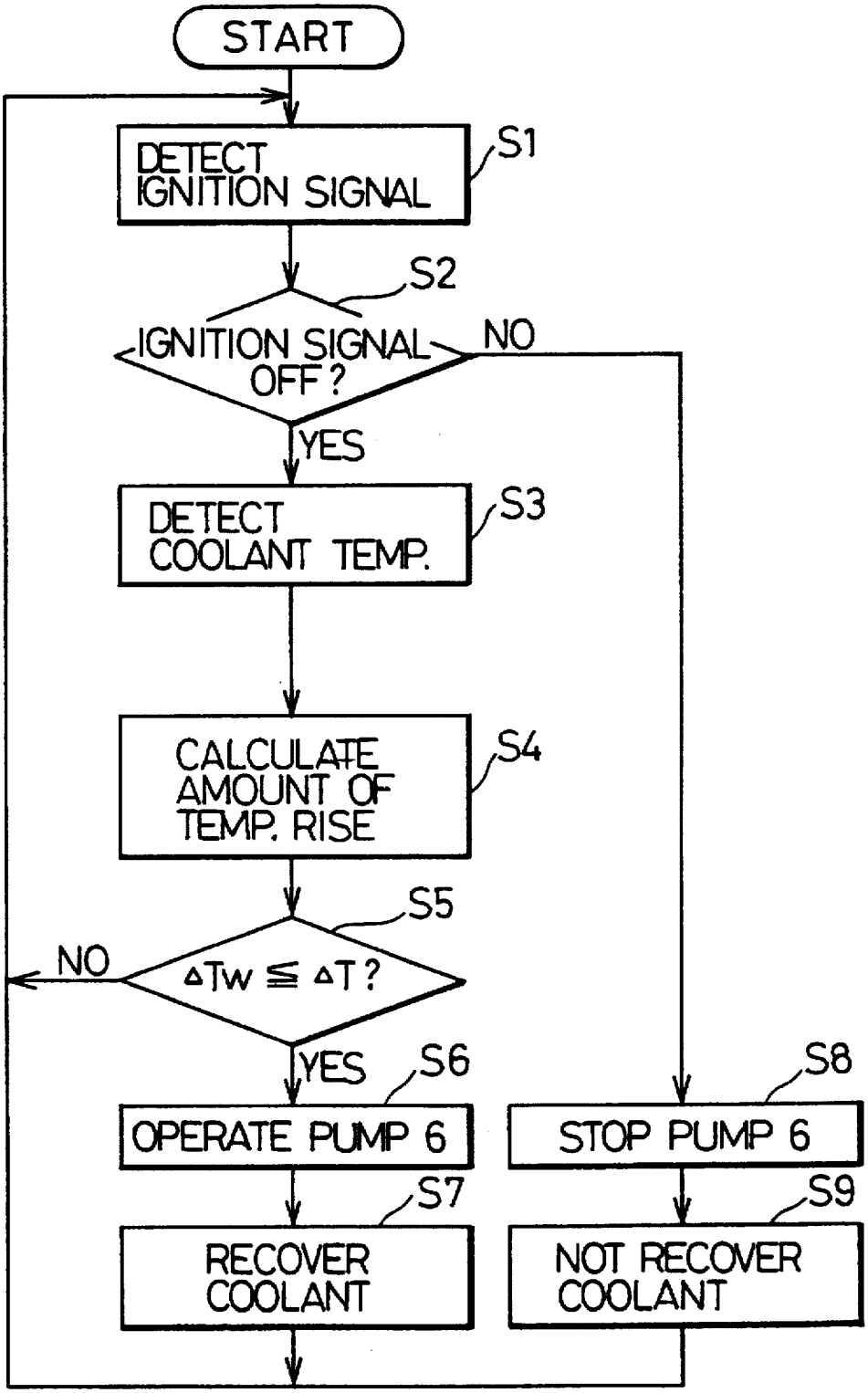
FIG. 3 is a flowchart in the coolant recovery mode.
Figure 4:
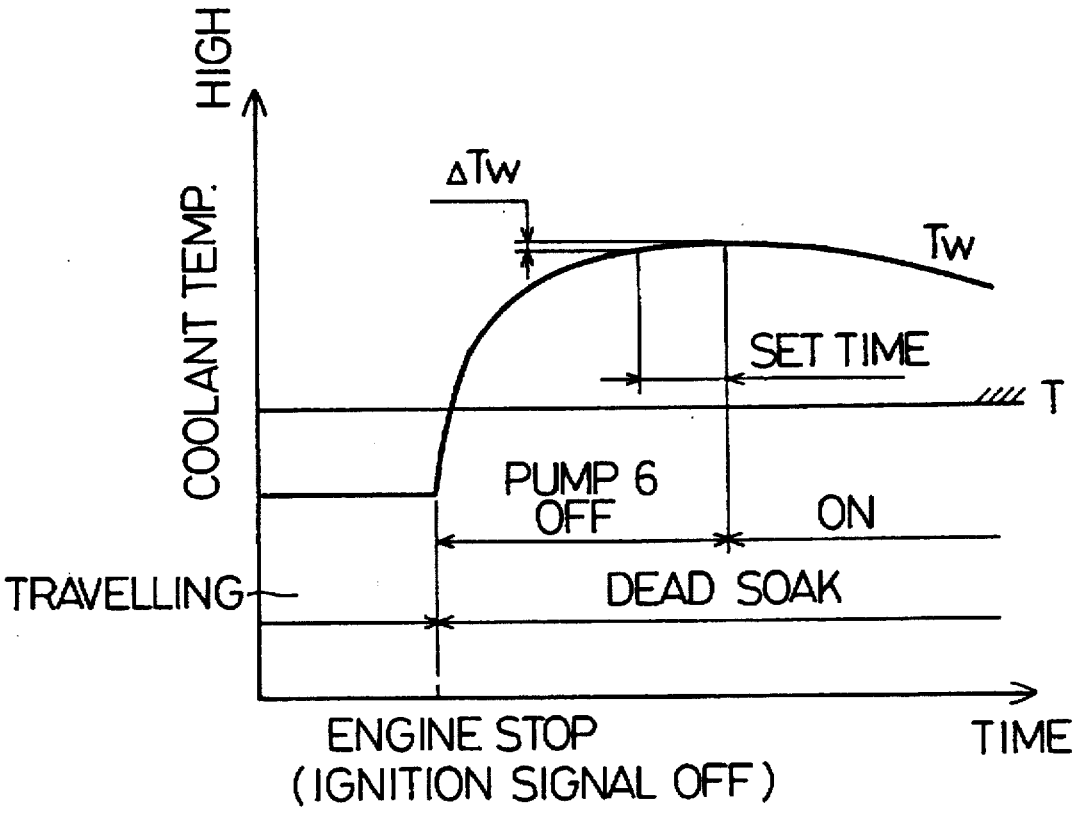
FIG. 4 is a graph indicating a variation in coolant temperature after the engine has stopped.
Figure 5:
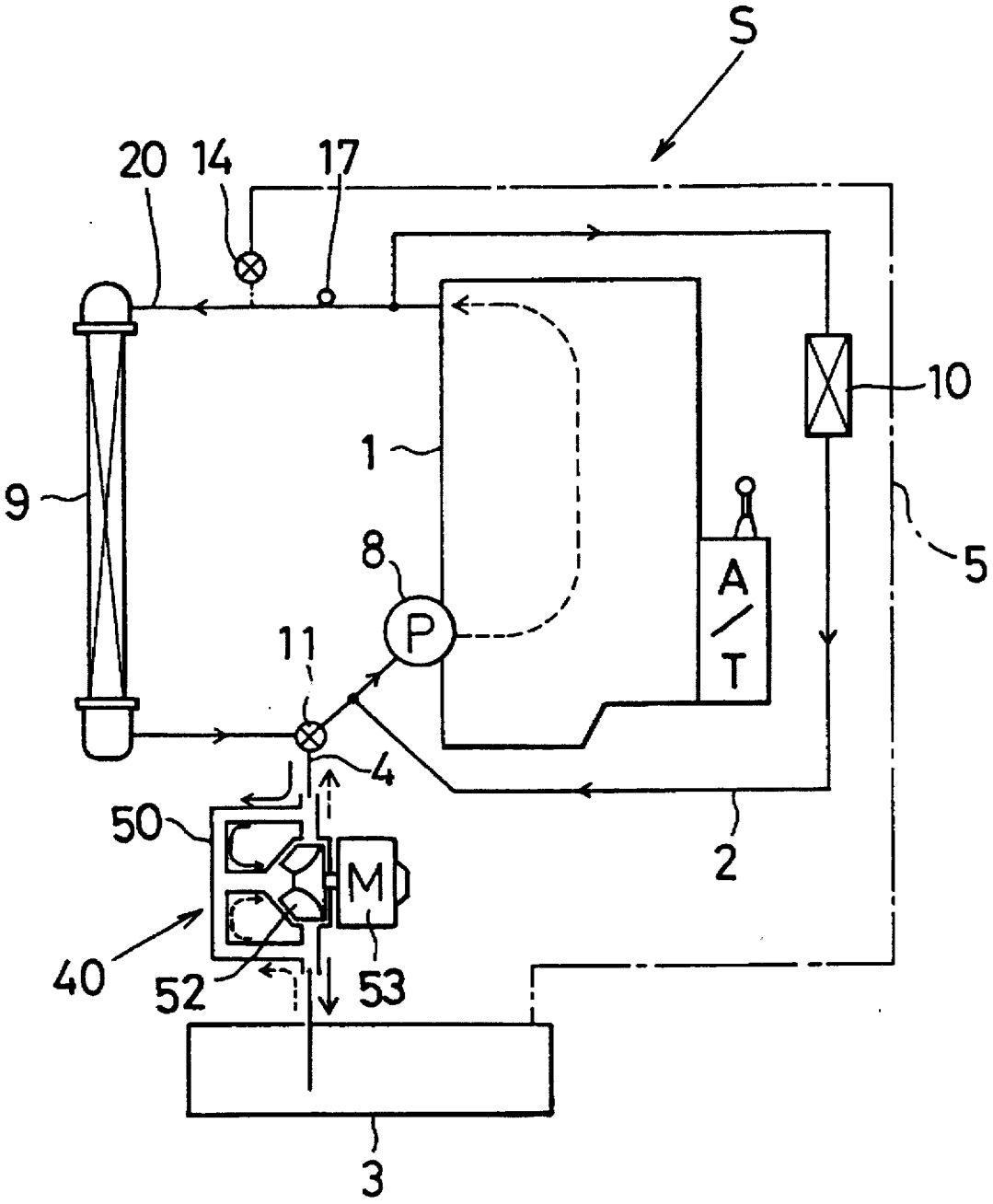
FIG. 5 is an overall schematic view showing a coolant control system according to a second embodiment.
Figure 6:
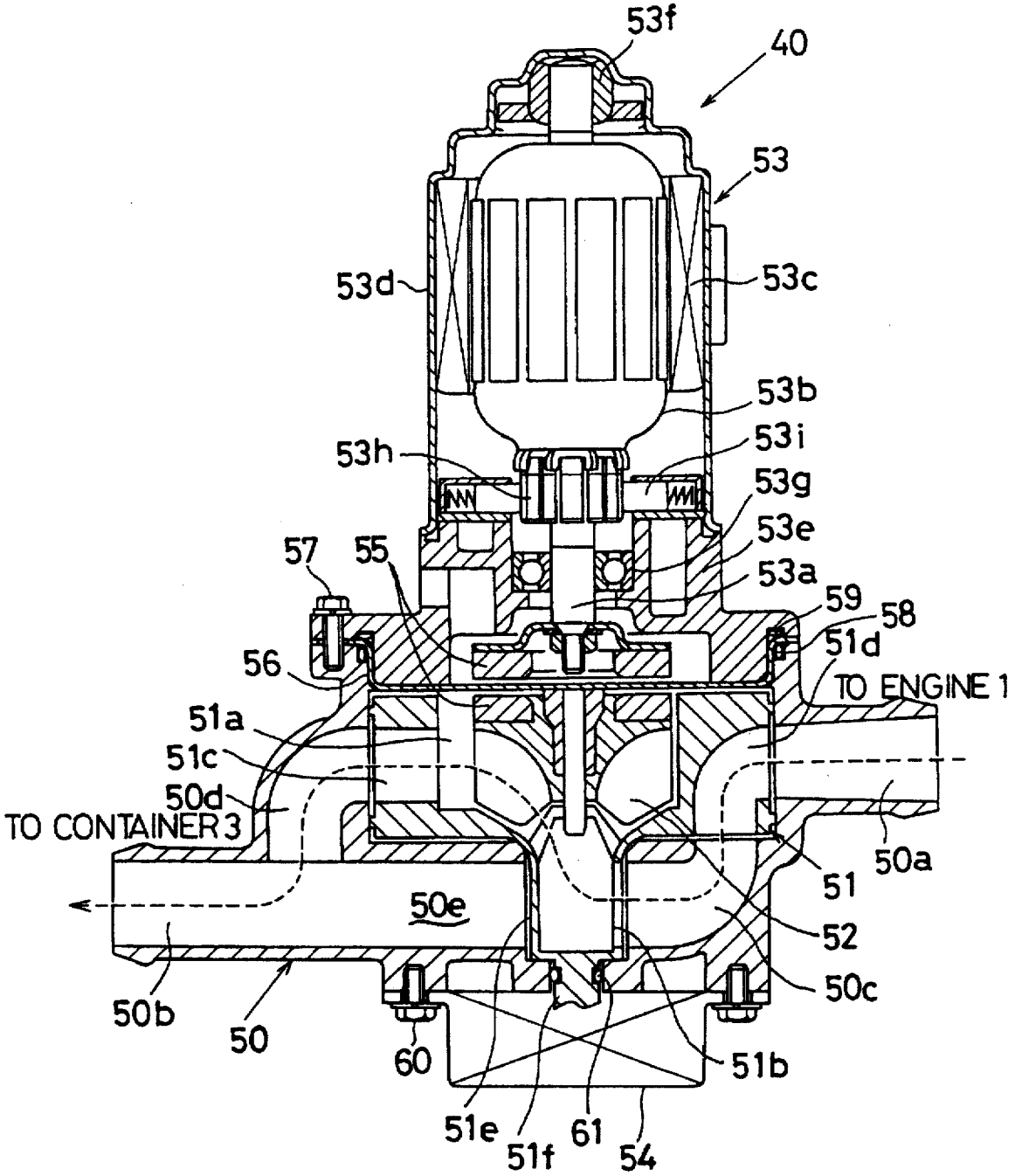
FIG. 6 is a cross-sectional view of the electrical pump where a variable casing is at a first position according to the embodiment shown in FIG. 5.
Figure 7:
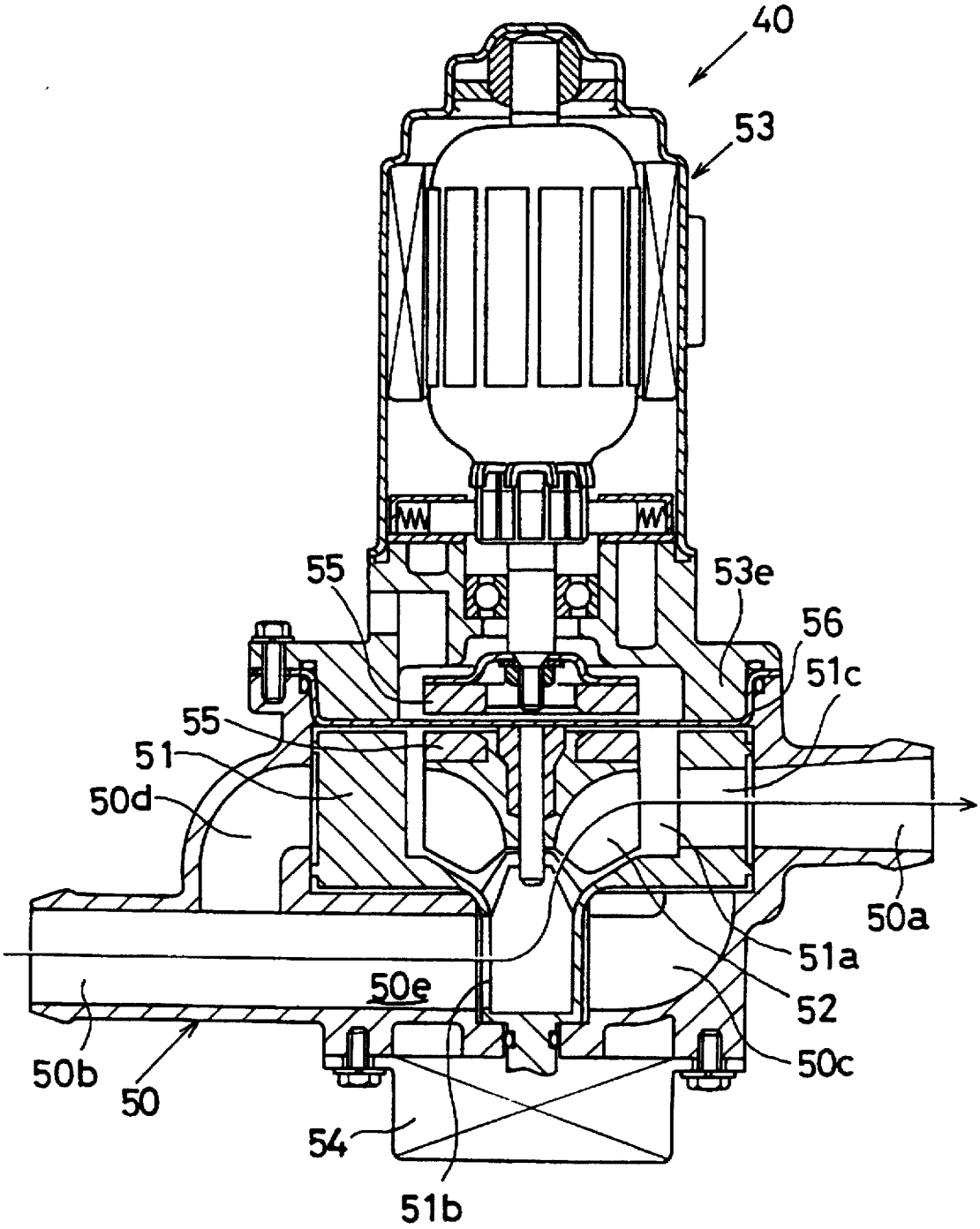
FIG. 7 is a cross-sectional view of the electrical pump where the variable casing is at a second position according to the embodiment shown in FIG. 5.
Figure 8:
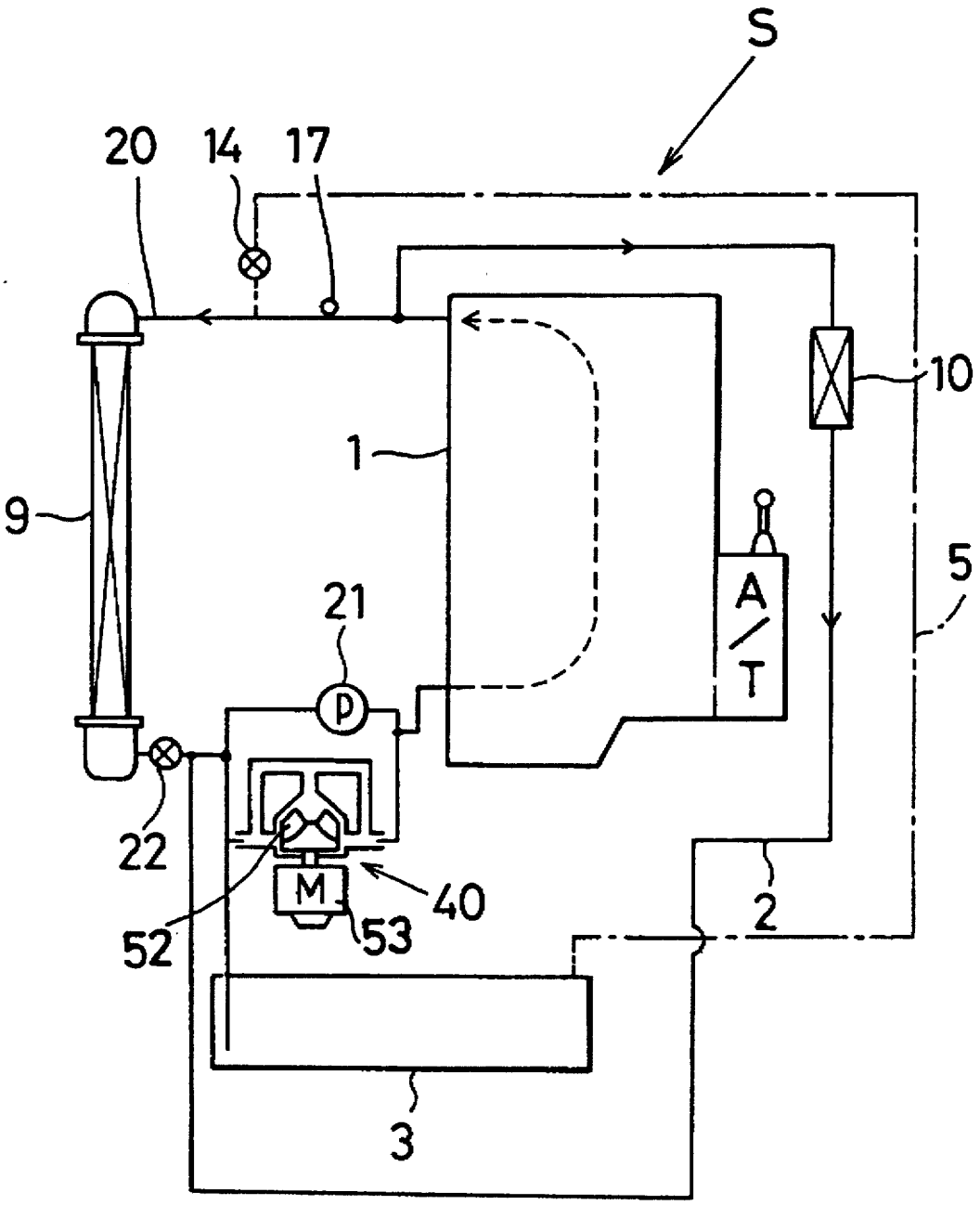
FIG. 8 is an overall schematic view showing a coolant control system according to a third embodiment.
Figure 9:
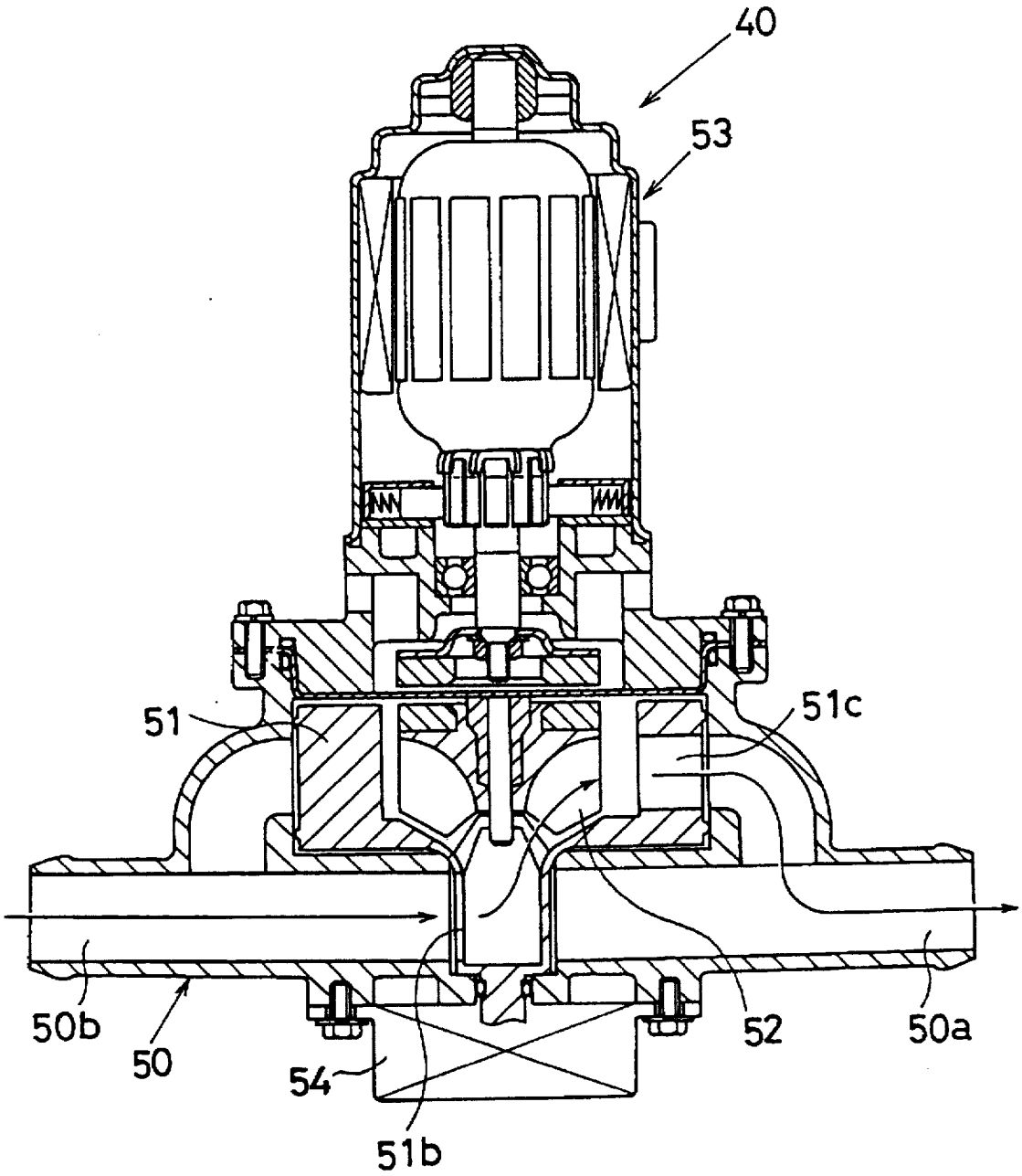
FIG. 9 is a cross-sectional view of a modification of the electrical pump.

Additional objects and advantages of the present invention will be more readily apparent from the following detailed description of preferred embodiments thereof when taken together with the accompanying drawings in which:

FIG. 1 is an overall schematic view of a coolant temperature control system for vehicles according to a first embodiment;

FIG. 2 shows a control unit of the control system according to the first embodiment;

FIG. 3 is a flowchart in the coolant recovery mode;

FIG. 4 is a graph indicating a variation in coolant temperature after the engine has stopped;

FIG. 5 is an overall schematic view showing a coolant control system according to a second embodiment;

FIG. 6 is a cross-sectional view of the electrical pump where a variable casing is at a first position according to the embodiment shown in FIG. 5;

FIG. 7 is a cross-sectional view of the electrical pump where the variable casing is at a second position according to the embodiment shown in FIG. 5;

FIG. 8 is an overall schematic view showing a coolant control system according to a third embodiment; and FIG. 9 is a cross-sectional view of a modification of the electrical pump.

DETAILED DESCRIPTION OF THE PREFERRED EMBODIMENTS

An embodiment of a coolant temperature control system for vehicles according to the present invention will be described.

FIG. 1 is an overall schematic view of a coolant temperature control system S for vehicles.

Coolant temperature control system S includes a water-cooled engine 1, a coolant circuit 2 through which coolant (cooling water) circulates into the engine 1, an insulated container 3 for coolant, a coolant passage 4 and a degassing passage 5 for communicating engine 1 with insulated container 3 through coolant circuit 2, an electrical pump 6 disposed in coolant passage 4, and a control unit 7 (see FIG. 2) for controlling system S.

Engine 1 is provided with a water jacket (not illustrated) in a cylinder block and a cylinder head for communicating with coolant circuit 2, and is cooled by coolant flowing through the water jacket.

Coolant circuit 2 is provided with a mechanical type main pump 8 driven by engine 1, a radiator 9 for radiating heat of coolant heated by cooling engine 1 to the atmosphere with air blown by a cooling fan (not illustrated), and a heater core 10 for heating air passing therethrough (i.e., air blown into the passenger compartment) with high-temperature coolant as a heat source.

Insulated container 3 can accumulate a predetermined amount (for example approximately 3 liters) of coolant therein for an extended period while maintaining the temperature of the coolant. Specifically, coolant of approximately 85° C. can be kept warm to approximately 78° C. after 12 hours has passed in an ambient temperature of 0° C.

One end of coolant passage 4 is connected through a solenoid valve 11 to coolant circuit 2 on a downstream side of radiator 9, and the other end is opened to the interior of insulated container 3. However, coolant passage 4 forms a coolant recovering passage (the passage indicated by solid-line arrows in the drawing) for recovering coolant in insulated container 3 from engine 1 or a coolant return passage (the passage indicated by broken-line arrows in the drawing) for returning coolant from insulated container 3 to engine 1. The coolant recovering passage and coolant return passage are switched by solenoid valve 11 and two solenoid valves 12 and 13 disposed in coolant passage 4.

One end of degassing passage 5 is opened to the interior of insulated container 3, and the other end is connected to coolant circuit 2 on the upstream side of radiator 9. Air flows in a direction oppositely to the direction of coolant flow when coolant passes through coolant passage 4 and is recovered into insulated container 3 from engine 1 and when coolant is returned from insulated container 3 to engine 1. That is, when coolant passes through coolant passage 4 (i.e., the coolant recovering passage) and is recovered into insulated container 3 from engine 1, air in insulated container 3 passes through degassing passage 5 and is sent into engine 1, and when coolant passes through coolant passage 4 (i.e., the coolant return passage) and is returned from insulated container 3 into engine 1, air in engine 1 passes through air degassing passage 5 and is sent into insulated container 3. Additionally, a solenoid valve 14 for opening and closing degassing passage 5 is provided in degassing passage 5.

Electrical pump 6 is preferably a centrifugal type pump driven so as to rotate by a motor (not illustrated), and generate coolant flow (indicated by arrows in FIG. 1) in coolant passage 4.

Control unit 7 controls electrical pump 6 and solenoid valves 11 through 14 in each operating mode, which will be described below (see FIG. 2).

Operating modes include a low-load mode when engine 1 is in a low load operating condition where the vehicle travel is low, a middle-high load mode when engine 1 is in a middle or high load operating condition, a coolant recovery mode when coolant is recovered into insulated container 3 from engine 1 after engine 1 has stopped, and a coolant return mode when coolant is returned from insulated container 3 into engine 1 during engine starting.

The load condition of engine 1 can be determined on the basis of a detected signal of a pressure sensor 15 (see FIG. 2) for detecting pressure change of, for example, an intake manifold (not illustrated) and converting the pressure change to a voltage change.

Additionally, the coolant recovery mode is ended when a water level of coolant collected within insulated container 3 has reached an upper-limit water level which was set in advance. Meanwhile, the coolant return mode is ended when the water level of coolant collected within insulated container 3 has reached a lower-limit water level which was set in advance. The water level of the coolant can be detected by a water-level sensor 16 (see FIG. 2).

Operating conditions of main pump 8, electrical pump 6, and each of solenoid valves 11 through 14 in the respective operating modes is indicated in Table 1.

TABLE 1

| MODE | MAIN PUMP 8 | PUMP 6 | VALVE 11 | VALVE 12 | VALVE 13 | VALVE 14 |
|---|---|---|---|---|---|---|
| LOW LOAD | ON | OFF | CLOSED | CLOSED | CLOSED | CLOSED |
| MIDDLE-HIGH LOAD | ON | OFF | 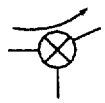 | CLOSED | CLOSED | CLOSED |
| RECOVERY OF COOLANT | OFF | ON | 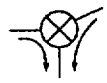 OR 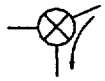 | 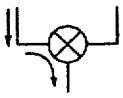 | 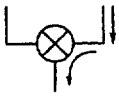 | OPEN |

TABLE 1-continued

| MODE | MAIN PUMP 8 | PUMP 6 | VALVE 11 | VALVE 12 | VALVE 13 | VALVE 14 |
|---|---|---|---|---|---|---|
| RETURN OF COOLANT | OFF | ON | | | | OPEN |

After engine 1 has stopped, the operation of each of solenoid valves 11 through 14 is controlled as shown in Table 1, and electrical pump 6 can be operated to recover coolant in engine 1 into insulated container 3. At this time, air is pushed out from insulated container 3 as the coolant is being recovered into insulated container 3, and the air passes through degassing passage 5 and is sent into engine 1 (particularly the water jacket within the cylinder head). In this way, high-temperature coolant is accumulated in insulated container 3, and the water jacket in engine 1 defines an air passage (air tank).

However, immediately after the engine has stopped, the coolant has not reached its maximum temperature. A maximum-temperature region of coolant due to the dead-soak phenomenon (see FIG. 4) where coolant temperature actually rises after engine 1 has stopped is determined by the present invention to recover coolant having a higher temperature into insulated container 3 as will be described later herein.

When engine 1 is in a starting condition, the operation of each of solenoid valves 11 through 14 is controlled as shown in Table 1, electrical pump 6 is operated, and high-temperature coolant accumulated in insulated container 3 is returned to engine 1. At this time, air is pushed out from engine 1 as is being recovered into engine 1, and air passes through degassing passage 5 and is sent into insulated container 3. For this reason, the interior of engine 1 is filled with high-temperature coolant, and the interior of insulated container 3 becomes substantially empty. Coolant passage 4 (coolant return passage) and electrical pump 6 constitute means for supplying coolant in this embodiment.

Operation in the coolant recovery mode will be described hereinafter with reference to the flowchart indicated in FIG. 3.

Firstly, it is determined whether engine 1 is in a travelling condition or in a stopping condition. Specifically, an ignition signal (IG signal) is detected at step S1, and an on/off state of the detected IG signal is determined at step S2. When the IG signal is off according to the determination (the determination result is no), that is, when engine 1 is in a travelling condition, coolant for cooling engine 1 cannot be recovered into insulated container 3. Consequently, electrical pump 6 is stopped at step S8, and coolant is not recovered at step S9.

When the IG signal was determined on at step S2 (the determination result is yes), that is, when engine 1 is in a stopping condition, coolant temperature (temperature Tw) is detected by a coolant-temperature sensor 17 (see FIG. 1) provided in coolant circuit 2 at step S3.

Sequentially, an amount of temperature rise of coolant after engine 1 has stopped is calculated at step S4. Specifically, a temperature difference (Tw−Tw-1) between the present coolant temperature Tw detected at step S3 and the last coolant temperature Tw-1 previously detected is calculated as an amount of temperature rise ΔTw (see FIG. 4). The graph in FIG. 4 indicates a variation in coolant temperature after engine 1 has stopped.

Sequentially, a comparative determination is performed for the amount of temperature rise ΔTw calculated at step S4 and the set amount of temperature rise ΔT which was set in advance at step S5. When the determination is ΔTw>ΔT (the determination result is no), it is determined that "the amount of temperature rise is large and the coolant temperature is still rising", and it returns to step S1 without operating electrical pump 6, and the process of step S1 and the following steps is repeated.

Eventually, the determination at step S5 will become ΔTw≦T (determination result: yes). This determines that "the amount of temperature rise is small and the present temperature is substantially the maximum temperature". Electrical pump 6 is operated at step S6, and coolant is recovered at step S7.

When coolant temperature has reached substantially the maximum temperature after engine 1 has stopped (ΔTw≦ΔT), electrical pump 6 is driven and coolant recovered into insulated container 3 from engine 1. That is, after engine 1 has stopped, coolant which has reached the highest temperature can be recovered and kept in insulated container 3. Consequently, coolant having a higher temperature as compared with the conventional prior art systems can be supplied from insulated container 3 to engine 1 during engine starting, and engine 1 startability is improved.

Additionally, in the coolant recovery mode, coolant in engine 1 and air in insulated container 3 can be exchanged and the water jacket within engine 1 can be used for an air passage (air tank). For this reason, when high-temperature coolant accumulated in insulated container 3 is returned to engine 1 during engine starting, the temperature of engine 1 (particularly the wall temperature of the combustion chamber) increases rapidly. Consequently, since the engine-warming can be performed immediately and efficiently during engine starting, the combustion condition can be improved, exhaust gas can be reduced, and fuel consumption can be lowered.

In system S according to the above embodiment, the amount of coolant flowing to radiator 9 is controlled by operation of solenoid valve 11, however, in coolant circuit 2, by providing a bypass water path for bypassing radiator 9 and a thermostat for opening or closing the water path to radiator 9, the amount of coolant flowing to radiator 9 can be controlled by the thermostat. In such a case, solenoid valve 11 can be eliminated.

Further, in system S according to the above embodiment, a centrifugal type electrical pump 6 is provided in coolant passage 4, however, it is also acceptable to utilize a pump (for example a gear pump) which can reverse the direction of coolant flow by reversing the direction of rotation in the coolant recovery mode and in the coolant return mode. In such a case, the coolant recovering passage and the coolant return passage are used commonly, and coolant passage 4 can be thereby simplified.

A second embodiment of a coolant temperature control system for vehicles, employing a variable-passage type pump, according to the present invention will be described with reference to the drawings. Parts and components which are identical or equivalent to those in the first embodiment are shown by the same reference numerals.

An overall schematic view of a coolant temperature control system for vehicles is shown in FIG. 5.

A coolant temperature control system S for vehicles includes water-cooled engine 1, insulated container 3 for keeping warm coolant therein, coolant passage 4 and degassing passage 5 for communicating engine 1 and insulated container 3 through a coolant circuit (which will be described later) of engine 1, an electrical pump 40 provided in coolant passage 4 and control unit 7 for controlling system S.

Engine 1 is provided with a water jacket (not illustrated) which defines a passage for coolant in a cylinder block and a cylinder head (both not illustrated), and is cooled by coolant flowing through the water jacket.

Insulated container 3 can accumulate a predetermined amount (for example approximately 3 liters) of coolant therein for an extended period while maintaining he temperature of the coolant. For example, coolant of approximately 85° C. can be kept warm up to approximately 78° C. after 12 hours has passed in ambient temperature of 0° C.

The coolant circuit includes a radiator circuit 20 for connecting engine 1 to radiator 9, and heater circuit 2 connected to radiator circuit 20 for connecting engine 1 with heater core 10. Coolant is circulated by mechanical main pump 8 driven by engine 1.

Radiator 9 radiates heat of coolant heated by cooling engine 1 to the atmosphere with air blown by a cooling fan (not illustrated).

Heater core 10 is disposed in a duct (not illustrated) for blowing air into a passenger compartment, and heats air passing through heater core 10 (i.e., air blown into the passenger compartment) with high-temperature coolant as a heat source.

One end of coolant passage 4 is connected through a three-way valve 11 to radiator circuit 20 on a downstream side of radiator 9, and the other end is opened to the interior of insulated container 3. Coolant passage 4 forms a coolant recovering passage to recover coolant in insulated container 3 from engine 1 after engine 1 has stopped, or forms a coolant return passage to return coolant from insulated container 3 to engine 1 during engine starting.

One end of degassing passage 5 is connected to an upper-end surface of insulated container 3 and is opened to the interior of insulated container 3. The other end of degassing passage 5 is connected to radiator circuit 20 at an upstream side of radiator 9. In degassing passage 5, air flows in a direction oppositely to the direction of coolant flow when coolant is recovered into insulated container 3 from engine 1 and when coolant is returned from insulated container 3 to engine 1. That is, when coolant passes through coolant passage 4 and is recovered in insulated container 3 from engine 1, air in insulated container 3 passes through air degassing passage 5 and is sent into engine 1, and when coolant passes through coolant passage 4 and is returned from insulated container 3 to engine 1, air in engine 1 passes through degassing passage 5 and is sent into insulated container 3. Additionally, a solenoid valve 14 for opening or closing degassing passage 5 is provided in degassing passage 5.

Electrical pump 40 is disposed in coolant passage 4 and generates coolant flow in coolant passage 4. Electrical pump 40 changes the direction of flow of coolant by being controlled with electric current from control unit 7.

A structure of electrical pump 40 will be described hereinafter with reference to FIGS. 6 and 7.

Electrical pump 40 includes an outer casing 50 having a first port 50*a* and a second port 50*b* which constitute an inlet port and an outlet port for coolant, respectively, a variable casing 51 rotatably supported in outer casing 50 for forming a pump chamber 51*a* therein, an impeller 52 rotatably accommodated in pump chamber 51*a*, a motor 53 for rotating impeller 52 and a servomotor 54 for driving variable casing 51.

Outer casing 50 is provided with first port 50*a* and second port 50*b* in a predetermined positional relationship (indicated by 180° in FIGS. 6 and 7) in the rotational direction. First port 50*a* and second port 50*b* are connected to engine 1 and insulated container 3, respectively. Outer casing 50 is provided with communicating water passages 50*c* and 50*d* for communicating between first port 50*a* and second port 50*b* through variable casing 51 when coolant is recovered from engine 1 to insulated container 3. Outer casing 50 is further provided with a communicating water passage 50*e* for communicating between second port 50*b* and first port 50*a* through variable casing 51 when coolant is returned from insulated container 3 into engine 1.

Variable casing 51 is formed with an intake port 51*b* and a discharge port 51*c* and a communicating passage 51*d* for communicating between first port 50*a* and second port 50*b* of the outer casing 50 through pump chamber 51*a*, and changes the direction of flow of coolant according to its rotational position. Intake port 51*b* is opened to a side surface of a cylindrical portion 51*e* protruding below pump chamber 51*a*. Discharge port 51*c* is opened to the side surface of pump chamber 51*a*. Additionally, communicating passage 51*d* communicates between first port 50*a* and second port 50*b* of outer casing 50 when coolant is recovered into insulated container 3 from engine 1.

A position in the rotational direction of variable casing 51 relative to outer casing 50 is changed by servomotor 54 when recovering coolant and when returning coolant. That is, when recovering coolant, variable casing 51 is rotated to a first position wherein intake port 51*b* communicates with communicating water passage 50*c* of the outer casing 50 and discharge port 51*c* communicates with communicating water passage 50*d*, as shown in FIG. 6. At this first position, first port 50*a* and communicating water passage 50*c* of outer casing 50 in communicated through communicating passage 51*d* of variable casing 51. When returning coolant, variable casing 51 is rotated to a second position wherein intake port 51*b* communicates with communicating water passage 50*e* and discharge port 51*c* communicates with first port 50*a*, as shown in FIG. 7.

Impeller 52 rotates in one direction in pump chamber 51*a* so as to generate coolant flow from intake port 51*b* toward discharge port 51*c* of variable casing 51. By the rotation of impeller 52, coolant flow from first port 50*a* toward second port 50*b* is generated when variable casing 51 is at the first position, as shown by the broken-line arrow in FIG. 6, and coolant flow from second port 50*b* toward first port 50*a* is generated when variable casing 51 is at the second position, as shown by the solid-line arrow in FIG. 7.

Motor 53 rotates impeller 52 in one direction via a magnet coupling 55, and includes a rotor 53*b* having a rotation shaft 53*a*, a stator 53*c* (permanent magnet) disposed on an outer periphery of rotor 53*b*, a frame 53*d* for forming an outer shell, and a housing 53*e* for covering an opening portion of the frame 53*d*. One end (the upper end in FIGS. 6 and 7) of rotor 53*b* is rotatably supported on frame 53*d* via a bearing 53*f*, and the other end is rotatably supported on housing 53*e* via a bearing 53*g*. A commutator 53*h* is mounted on rotation shaft 53*a*, and current is supplied to rotor 53*b* through a brush 53*i* which slides on an outer peripheral surface of commutator 53*h*.

Motor 53 is fixed to an upper portion of outer casing 50 by a bolt 57, while sandwiching a thin plate 56 made of metal or resin. Plate 56 sealingly encloses a space in outer casing 50 so as to accommodate variable casing 51. The interface between plate 56 and outer casing 50 and between plate 56 and housing 53*e* are sealed by gaskets 58 and 59, respectively.

Servomotor 54 is fixed to a bottom portion of outer casing 50 by a bolt 60, is interconnected with a shaft portion 51*e* which protrudes downwardly from a cylindrical portion 51*f* of variable casing 51, and rotates variable casing 51 between the first position and second position. A gasket 61 which seals the interface with outer casing 50 is mounted on an outer periphery of shaft portion 51*f*.

Control unit 7 controls the operation of electrical pump 40, three-way valve 11, and solenoid valve 14 in accordance with an operating mode which will be described below.

Operating modes includes a low-load mode when engine 1 is in a low load operating condition when the vehicle travel is low, a middle-high load mode when engine 1 is in a middle or high load operating condition, a coolant recovery mode when coolant is recovered into insulated container 3 from engine 1 after engine 1 has stopped, and a coolant return mode when coolant is returned from insulated container 3 into engine 1 during engine starting.

The load state of engine 1 during the low load mode and the middle-high load mode can be determined on a basis of a detection signal of a pressure sensor 15 (see FIG. 2) to detect pressure change of for example an intake manifold (not illustrated) and convert the pressure change to a voltage change.

The coolant recovery mode is performed after engine 1 has stopped (for example, when an "off" signal of an ignition switch IG has been detected).

The coolant return mode is performed during engine starting (for example, when an "on" signal of the ignition switch IG has been detected).

Additionally, the coolant recovery mode is ended when a water level of coolant recovered in insulated container 3 has reached an upper-limit water level which was set in advance. Similarly, the coolant return mode is ended when the water level of coolant collected in insulated container 3 has reached a lower-limit water level which was also set in advance. The water level of the coolant can be detected by a water-level sensor 16 (see FIG. 2).

Herein, each operating condition of electrical pump 40, three-way valve 11, and solenoid valve 14 by control unit 7 according to each operating mode is indicated in Table 2.

TABLE 2

| MODE | MAIN PUMP 8 | PUMP 40 | THREE-WAY VALVE 11 | VALVE 14 |
|---|---|---|---|---|
| LOW LOAD | ON | OFF | CLOSED | CLOSED |
| MIDDLE-HIGH LOAD | ON | OFF | 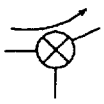 | CLOSED |
| RECOVERY OF COOLANT | OFF | ON 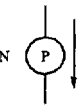 | 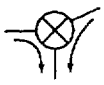 OR 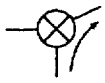 | OPEN |

A mode of operation according to the present embodiment will be described with reference to the foregoing Table 2.

In a low load mode, coolant circulates only in heater circuit 2 by turning three-way valve 11 off and closing radiator circuit 20.

In a middle-high load mode, since temperature rise of coolant after engine 1 is cooled becomes large, coolant which has flowed out of engine 1 is needed to flow to radiator 9 to radiate heat. Accordingly, the passage of three-way valve 11 is switched so that coolant passing through engine 1 circulates in radiator circuit 20 and in heater circuit 2 (see Table 2).

In a coolant recovery mode, after engine 1 has stopped, solenoid valve 14 is switched on to open degassing passage 5, and the passage of three-way valve 11 is switched to the coolant passage 4 side (see Table 2). In this state, servomotor 54 of electrical pump 40 is controlled and variable casing 51 is rotated to the first position, and motor 53 is operated. As a result, coolant in engine 1 is recovered into insulated container 3 after passing through coolant passage 4, and simultaneously, air in insulated container 3 is sent into engine 1 after passing through degassing passage 5 (particularly the water jacket in the cylinder head). In this way, high-temperature coolant is accumulated in insulated container 3, and the water jacket in engine 1, from which coolant is drained, becomes an air passage (air tank).

In a coolant return mode, when engine 1 is starting, servomotor 54 of electrical pump 40 is controlled and variable casing 51 is rotated to the second position, and motor 53 is operated. As a result, high-temperature coolant accumulated in insulated container 3 is returned to engine 1 through coolant passage 4, and simultaneously, air in engine 1 is sent into insulated container 3 after passing through degassing passage 5. In this way, the interior of engine 1 is filled with high-temperature coolant, and the interior of insulated container 3 becomes substantially empty.

In the system S according to the second embodiment, the direction of flow of coolant can be reversed by switching variable casing 51 of electrical pump 40 between the first position and the second position. Consequently, since there is no need to individually form a coolant recovering path and a coolant return path except electrical pump 40, a simple piping structure having only one systematic line for connecting between three-way valve 11 and insulated container 3 can be obtained, and the overall piping length can also be shortened. Additionally, since electrical pump 40 itself also functions as a switching valve for switching the coolant path, there is no need to employ a switching valve other than three-way valve 11. As a result, a compact and low-cost system S, which is mounted on the vehicle easily, can be obtained.

Additionally, since electrical pump 40 of system S can establish the angle of rotation of variable casing 51 as desired by servomotor 54, it is possible to adjust the amount of water flow by appropriately varying the open area of intake port 51*b* and discharge port 51*c* of variable casing 51 with respect to variable casing 51.

According to the system S, in the coolant recovery mode, coolant in engine 1 and air in insulated container 3 can be exchanged, and the water jacket in engine 1 can be used for an air passage (air tank). For this reason, when high-temperature coolant accumulated in insulated container 3 is returned to engine 1 during engine starting, temperature of engine 1 (particularly the wall temperature of the combustion chamber) increases rapidly. Consequently, since the engine-warming can be performed immediately and efficiently during engine starting, the combustion condition can be improved, exhaust gas can be reduced, and fuel consumption can be lowered.

Additionally, according to the second embodiment, there is no need to add new coolant to the coolant system of engine 1. Since the amount of coolant of the entire coolant system does not increase, there is no increase in the vehicle weight with an increase in the amount of coolant.

Further, the engine-warming can be performed immediately and effectively by making the high-temperature coolant, which has accumulated in insulated container 3, flow to the heater core 10.

A third embodiment of the present invention will be described.

FIG. 8 is an overall schematic view of the system S according to the third embodiment.

In the third embodiment, an electrical main pump 21 is employed instead of a mechanical pump driven by engine 1. Since electrical main pump 21 is employed, the circuit structure of the system S differs from the second embodiment. Specifically, electrical pump 40 is connected in parallel with main pump 21, and a solenoid valve 22 is disposed on a downstream side of radiator 9 of radiator circuit 20 and upstream of the position of connection with heater circuit 2, as shown in FIG. 8.

Each operating condition of electrical pump 40, solenoid valve 14, solenoid valve 22, and main pump 21 in each operating mode according to the third embodiment is indicated in Table 3.

TABLE 3

| MODE | MAIN PUMP 21 | PUMP 40 | VALVE 22 | VALVE 14 |
|---|---|---|---|---|
| LOW LOAD | ON | OFF | CLOSED | CLOSED |
| MIDDLE-HIGH LOAD | ON | OFF | OPEN | CLOSED |

TABLE 3-continued

| MODE | MAIN PUMP 21 | PUMP 40 | VALVE 22 | VALVE 14 |
|---|---|---|---|---|
| RECOVERY OF COOLANT | OFF | ON 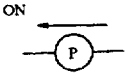 | OPEN OR CLOSED | OPEN |
| RETURN OF COOLANT | OFF | ON 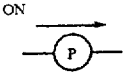 | CLOSED | OPEN |

According to the third embodiment as well, it is possible to immediately warm up engine 1 by recovering coolant in insulated container 3 from engine 1 while sending air in insulated container 3 into engine 1 after engine 1 has stopped and by returning high-temperature coolant which has accumulated in insulated container 3 into engine 1 while sending air in engine 1 into insulated container 3 during engine starting.

Additionally, a compact and low-cost system S, which is mounted on the vehicle easily, can be obtained by being structured with electrical pump 40 in the same manner as in the second embodiment.

According to third embodiment, first port 50*a* and second port 50*b* of outer casing 50 of electrical pump 40 are positioned to have a predetermined relationship in the rotational direction, however, the other structures than that shown in FIGS. 6 and 7 may be also acceptable. For example, first port 50*a* and second port 50*b* are positioned to have a relationship opposing each other by 180 degrees, as shown in FIG. 9. In such a case, communicating passage 51*d* in variable casing 51 is not necessary.

According to the system S in each of the above embodiments, thermal energy of coolant accumulated in insulated container 3 can be also utilized for controlling temperature of engine oil, hydraulic oil employed in an automatic transmission, or intake air, and for preventing a throttle body from being frozen, or the like.

According to each of the embodiments, the coolant level in insulated container 3 is detected by water-level sensor 16 in the coolant recovery mode and coolant return mode. However, the times required for the recovery and return of coolant may be measured in advance, and an operating time for each mode may be set by a timer within control unit 7 on the basis of the required time.

Although the present invention has been fully described in connection with the preferred embodiments thereof with reference to the accompanying drawings, it is to be noted that various changes and modifications will become apparent to those skilled in the art. Such changes and modifications are to be understood as being included within the scope of the present invention as defined in the appended claims.

What is claimed is:

1. A coolant temperature control system for vehicles having an engine cooled by coolant, said control system comprising:

an insulated container connected to said engine;

a pump for pumping coolant from said engine to said insulated container;

means for detecting coolant temperature after said engine has stopped;

means for determining whether said coolant temperature after said engine has stopped has reached a substantially maximum temperature on a basis of a detected value of said coolant temperature detecting means; and a control unit in communication with said detecting means and said determining means for actuating said pump when it has been determined by said maximum temperature determining means that said coolant temperature has reached said substantially maximum temperature.

2. A coolant temperature control system for vehicles according to claim 1, further comprising:

means for forming a coolant recovery passage between said engine and said insulated container.

3. A coolant temperature control system for vehicles according to claim 1, further comprising:

means for forming a degassing passage between said engine and said insulated container, said degassing passage allowing air to flow in a direction opposite to that of said coolant.

4. A coolant temperature control system for vehicles according to claim 1, wherein said maximum temperature determining means determines whether coolant temperature after said engine has stopped has reached said substantially maximum temperature on a basis of a difference between a present coolant temperature and a previous coolant temperature detected by said coolant temperature detecting means, said present coolant temperature being detected a specified time period after said previous coolant temperature was detected.

5. A coolant temperature control system for vehicles according to claim 1, further comprising:

means for calculating an amount of temperature rise per set time from said detected value of said coolant temperature detecting means, wherein said maximum temperature determining means determines that said coolant temperature has reach said substantially maximum temperature when an amount of temperature rise calculated by said temperature rise calculating means has reached a set amount of temperature rise or less.

6. A coolant temperature control system for vehicles according to claim 1, further comprising:

means for supplying coolant thermally kept by said insulated container to said engine during starting of said engine.

7. A coolant temperature control system for vehicles according to claim 1, wherein, said pump includes:

an outer casing having an inlet connected to said engine and an outlet connected to said insulated container;

a variable casing rotatably supported in said outer casing and forming a pump chamber therein, said variable casing having an intake port and a discharge port, both of which are open to said pump chamber, said variable casing being rotated between a first position where said intake port communicates with said inlet and said discharge port communicates with said outlet and a second position where said intake port communicates with said outlet and said discharge port communicates with said inlet;

an impeller rotatably accommodated in said pump chamber for generating coolant flow form said intake port toward said discharge port;

a motor for rotating said impeller; and an actuator for actuating said variable casing between said first position and said second position.

8. A coolant temperature control system for vehicles according to claim 7, wherein said actuator is a servomotor.

9. A coolant temperature control system for vehicles according to claim 7, wherein said variable casing is rotated to said first position after said engine has stopped and is rotated to said second position during starting of said engine.

10. A coolant temperature control system for vehicles having an engine cooled by coolant, comprising:

an insulated container connected to said engine;

means for pumping coolant from said engine to said insulated container; and control means for actuating said coolant pumping means after said engine has stopped;

wherein said control means delays actuating said coolant pumping means for a specified period after said engine has stopped.

11. A coolant temperature control system for vehicles according to claim 10, further comprising:

means for detecting coolant temperature after said engine has stopped; and means for determining whether coolant temperature after said engine has stopped has reached a substantially maximum temperature on a basis of a detected value of said coolant temperature detecting means to define said specified period;

wherein said control means actuates said coolant pumping means when it has been determined by said maximum temperature determining means that said coolant temperature has reached said substantially maximum temperature.

12. A coolant temperature control system for vehicles according to claim 11, wherein said maximum temperature determining means determines whether coolant temperature after said engine has stopped has reached said substantially maximum temperature on a basis of a difference between a present coolant temperature and a pervious coolant temperature detected by said coolant temperature detecting means, said present coolant temperature being detected a specified time period after said previous coolant temperature.

13. A coolant temperature control system for vehicles according to claim 11, further comprising:

means for calculating an amount of temperature rise per set time from said detected value of said coolant temperature detecting means, wherein said maximum temperature determining means determines that said coolant temperature has reach said substantially maximum temperature when an amount of temperature rise calculated by said temperature rise calculating means has reached a set amount of temperature rise or less.

14. A coolant temperature control system for vehicles having a water-cooled engine cooled by coolant, comprising:

an insulated container connected to said engine;

means for pumping coolant from said engine to said heat insulating container; and control means for actuating said coolant pumping means after said engine has stopped, wherein said control means actuates said coolant pumping means after a specified period has passed since said engine stopped.

15. A coolant temperature control system for vehicles according to claim 14, further comprising:

means for detecting coolant temperature after said engine has stopped; and means for determining whether coolant temperature after said engine has stopped has reached a substantially maximum temperature on a basis of a detected value of said coolant temperature detecting means to define said specified period;

wherein said control means actuates said coolant pumping means when it has been determined by said maximum temperature determining means that said coolant temperature has reached said substantially maximum temperature.

16. A coolant temperature control system for vehicles according to claim 14, wherein said maximum temperature determining means determines whether coolant temperature after said engine has stopped has reached said substantially maximum temperature on a basis of a difference between a present coolant temperature and a previous coolant temperature detected by said coolant temperature detecting means, said present coolant temperature being detected a specified time period after said previous coolant temperature.

17. A coolant temperature control system for vehicles according to claim 14, further comprising:

means for calculating an amount of temperature rise per set time from said detected value of said coolant temperature detecting means, wherein said maximum temperature determining means determines that said coolant temperature has reach said substantially maximum temperature when an amount of temperature rise calculated by said temperature rise calculating means has reached a set amount of temperature rise or less.

* * * * *